United States Patent [19]

Sakaguchi et al.

[11] 4,201,589

[45] May 6, 1980

[54] SILVER HALIDE PHOTO-SENSITIVE MATERIAL PREPARED WITH SOLVENT AND SOLVENT SOLUBLE POLYMER

[75] Inventors: Shinji Sakaguchi; Seiiti Kubodera; Jun Arakawa; Keisuke Shiba; Nobuo Tsuji, all of Minami-ashigara, Japan

[73] Assignees: Fuji Photo Film Co., Ltd., Minami-ashigara, Japan; National Patent Development Corporation, New York, N.Y.

[21] Appl. No.: 31,850

[22] Filed: Apr. 20, 1979

Related U.S. Application Data

[63] Continuation of Ser. No. 605,390, Aug. 6, 1975, abandoned.

[30] Foreign Application Priority Data

Aug. 26, 1974 [JP] Japan ..... 49-96998

[51] Int. Cl.[2] ..... G03C 1/92; G03C 1/06; G03C 1/22; G03C 1/34

[52] U.S. Cl. ..... 430/139; 430/543; 430/566; 430/607; 430/627

[58] Field of Search ..... 96/100, 114, 109, 82, 96/95

[56] References Cited

U.S. PATENT DOCUMENTS

| | | | |
|---|---|---|---|
| 3,607,290 | 9/1971 | Butler | 96/114 |
| 3,655,389 | 4/1972 | Yasuda et al. | 96/100 |

*Primary Examiner*—Jack P. Brammer

*Attorney, Agent, or Firm*—Cushman, Darby & Cushman

[57] ABSTRACT

A silver halide photo-sensitive material is provided having a hydrophilic colloid layer containing dispersed therein finely divided particles of a substantially water-immiscible mixture containing a hydrophobic photographic substance. The aforesaid mixture contains a polymer having recurring units represented by the following general formula (I)

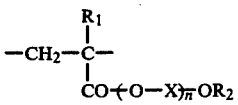

where, in the above formula, $R_1$ represents a hydrogen atom or methyl group, $R_2$ represents a hydrogen atom or substituted or unsubstituted aliphatic hydrocarbon radical containing 1 to 12 carbon atoms, X represents a bivalent substituted or unsubstituted aliphatic hydrocarbon radical containing 2 to 8 carbon atoms, and n is an integer of 1 to 50.

22 Claims, No Drawings

SILVER HALIDE PHOTO-SENSITIVE MATERIAL PREPARED WITH SOLVENT AND SOLVENT SOLUBLE POLYMER

This is a continuation, division, of application Ser. No. 605,390, now abandoned.

This invention relates to a silver halide photo-sensitive material. More particularly, it is concerned with an improved silver halide photo-sensitive material capable of being quickly developed to give a vivid color image.

It is known that in photography, especially in color photography, there is normally used a coupler which reacts, during the developing step accompanying reduction of silver halide particles by means of a color developer, with an oxidation product of the color developer such as a para-aminophenol derivative, a paraphenylenediamine derivative or like aromatic primary amino compound to form a color image constituted of an indophenol, indoamine, azomethine, indoaniline, phenoxazine, phenazine or like coloring matter.

In certain color photography, the coupler is incorporated in a color developing solution. In another type of color photography, there is used a coupler having a so-called ballast group which prevents the coupler diffusing or exuding into an adjacent emulsion layer or into a developing solution and the coupler is incorporated in a silver halide emulsion. The coupler having a ballast group and incorporated in a silver halide emulsion includes water-soluble couplers of the Fischer type, the molecules of which have been made bulky by combining a hydrocarbon radical containing 8 to 18 carbon atoms and made easily dispersible in silver halide emulsions by introducing a sulfo, carboxyl, phosphoryl or like water-soluble group and, in addition, hydrophobic couplers having a ballast group which is sufficiently bulky to make the coupler indiffusible.

The water-soluble couplers have the drawbacks that they increase the change in viscosity with elapse of time of a photo-sensitive emulsion incorporated therewith, they make it difficult to obtain a photo-sensitive material of uniform quality because of deposition during coating to form coating spots and they hardly provide a vivid and fast color image.

There have been known various methods of dispersing a hydrophobic coupler in a photo-sensitive emulsion. In the first method, a coupler is mixed with a high boiling oil or oil former, such as dibutyl phthalate, tricresyl phosphate, N,N-didecyllauramide or 2,4-di-n-amylphenol, and the resulting oily mixture is finely dispersed by the aid of a surface active agent in an emulsion, as disclosed in, e.g., U.S. Pat. Nos. 2,322,027, 2,533,514 and 3,835,579. In the second method, a coupler is dispersed in admixture with a so-called "resin" and an organic solvent in a gelatin solution and the resulting dispersion is added to a silver halide emulsion, as disclosed in U.S. Pat. Nos. 2,269,158, 2,272,191, 2,304,940, 2,311,020, 2,772,163, 2,852,382 and 3,619,195. In the third method, there is used a low boiling solvent as an auxiliary solvent in a similar manner to the first method, as disclosed in, e.g., U.S. Pat. Nos. 2,311,020, 2,360,289, 2,801,170 and 2,949,360. In the fourth method, there is used a low boiling coupler and the coupler is dispersed in oily state at an elevated temperature, as disclosed in, e.g., West Germany Pat. No. 1,143,707 and British Pat. No. 1,151,590. Besides there are various methods, as disclosed in, e.g., French Pat. No. 2,017,718, U.S. Pat. Nos. 3,287,134, 1,222,753, and 2,290,289, British Pat. Nos. 95,884, 1,122,753, 1,098,594, 1,099,414, 1,099,415, 1,099,416, 1,099,417 and 1,199,570 and U.S. Pat. Nos. 2,949,360, 3,396,027, 2,322,027 and 2,801,171.

The hydrophobic coupler is used in the form of fine particles dispersed in a colloidal solution. There is a strong demand for such a photo-sensitive material that can be developed quickly at an elevated temperature to give a color image, is of such high resolving power as to be able to record thereon information of a high density in a small area, and can be processed in a camera, automatic printer or automatic developing machine without being physically injured. To meet the demand, it is required to use couplers and silver halides in high concentrations in a photo-emulsion, to use a coupler dispersion in which a coupler is dispersed having no adverse effect on the physical strength of the coating film.

It is difficult to obtain a stable dispersion of a hydrophobic coupler in which the coupler is dispersed in fine particles especially of particle sizes of less than 0.2 microns and in a narrow range of particle size distribution by the aid of the known dispersants, such as an oil former, resin or high molecular weight colloid, for the hydrophobic coupler and the known dispersants have the drawback that they deteriorate the physical strength of a photo-sensitive layer when incorporated therein. The known dispersants for the hydrophobic coupler, when used in a relatively large amount compared to the coupler, sufficiently aid the color developing reaction and eliminate hindrance of the bleaching of the reduced silver which is formed accompanying formation of a color image and fixing, while, on the other hand, when used in a small amount, e.g., in a weight ratio to coupler of less than 0.5 to 1, there arises hindrance of the color developing reaction and bleaching of the reduced silver and fixing.

The dispersant to be used for dispersing a hydrophobic coupler in a photo-emulsion should combine the properties that it has an affinity to the coupler and to a protective colloid such as gelatin, it can disperse the coupler into fine particles and maintain the finely divided state of coupler particles for a long period of time, it promotes the color developing reaction rather than does not inhibit it, it promotes removal of reduced silver by bleaching and fixing or blix treatment and it has no adverse effect on the physical strength of the photo-emulsion film. It is difficult to conclude from the known information on structures and properties of polymers what kind of polymer would combine the aforesaid properties required for a polymer as a dispersant. The properties required for a polymer employed as a dispersant vary depending on the hydrophobic coupler, especially a bi-equivalent coupler and on the color developing agent.

Accordingly, an object of the present invention is to provide a novel polymer to be used for dispersing a hydrophobic photographic substance in a silver halide photo-emulsion and to provide, using the polymer, a photo-sensitive material having a silver halide photo-emulsion layer which combines the aforesaid properties in improved fashion.

Another object of the present invention is to provide a color photo-sensitive material having an emulsion layer which combines an excellent color developing property to give a vivid and sharp color image with a high physical strength.

Still another object of the present invention will be understood by the following descriptions.

The objects of the present invention have been accomplished by a silver halide (e.g., silver chloride, silver bromide or silver iodide) photo-sensitive material comprising a hydrophilic colloid layer incorporating dispersed therein fine particles of a substantially water-immiscible mixture containing a hydrophobic photographic substance in which said mixture contains a polymer having recurring units represented by the following general formula (I) and, more particularly, a silver halide photo-sensitive material comprising a silver halide photo-emulsion layer containing a hydrophilic colloid binder and dispersed in the binder silver halide particles, fine particles of an average diameter of 5 microns or less, of a substantially water-immiscible mixture containing a hydrophobic photographic substance and also containing an organic solvent soluble polymer having recurring units represented by the following general formula (I)

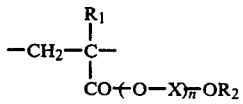

(I)

where, in the formula, $R_1$ is a hydrogen atom or methyl group, $R_2$ is a hydrogen atom or a substituted or unsubstituted aliphatic hydrocarbon radical containing 1 to 12 carbon atoms, X is a bivalent substituted or unsubstituted hydrocarbon radical containing 2 to 8 carbon atoms, and n is an integer of 1 to 50.

Thus $R_2$ can be hydrogen or alkyl and X can be alkylene, haloalkylene, e.g., chloroalkylene or bromoalkylene, or hydroxyalkylene. There can be present, for example, 1 or 2 halogen atoms or 1, 2 or 3 hydroxyl groups.

The polymer of the present invention is used as a dispersant for hydrophobic photographic substances. The polymer may be a homopolymer or a copolymer having the recurring units represented by the above general formula (I) and may be prepared by homopolymerization or copolymerization with other addition polymerizable unsaturated compounds, e.g., ethylenically unsaturated compounds, of a monomer represented by the general formula (II)

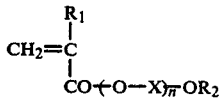

(II)

where, in the formula, $R_1$, $R_2$, X and n have the same meanings as designated above with regard to the general formula (I).

Though n may be 1 to 50, it is preferably 1 to 10 from the viewpoint of affinity to hydrophobic photographic substances, and $R_2$ is preferably a hydrogen atom or alkyl group containing 1 to 5 carbon atoms from the viewpoint of affinity to the protective colloid.

Examples of monomers represented by the general formula (II) are, e.g., 2-hydroxyethyl methacrylate, 3-hydroxypropyl methacrylate, 2-hydroxypropyl methacrylate, 2,3-dihydroxypropyl methacrylate, 4-hydroxybutyl methacrylate, 5-hydroxypentyl methacrylate, 2,2-dimethyl-3-hydroxypropyl methacrylate, diethyleneglycol monomethacrylate, triethyleneglycol monomethacrylate, dipropyleneglycol monomethacrylate, glycerol monomethacrylate, trimethylolethane monomethacrylate, trimethylolpropane monomethacrylate, trimethylolpentane monoacrylates, pentaerythritol monomethacrylate, 2-hydroxyethyl acrylate, 3-hydroxypropyl acrylate, 2-hydroxypropyl acrylate, 2,3-dihydroxypropyl acrylate, 4-hydroxybutyl acrylate, 5-hydroxypentyl acrylate, 2,2-dimethyl-3-hydroxypropyl acrylate, diethyleneglycol monoacrylate, triethyleneglycol monoacrylate, dipropyleneglycol monoacrylate, glycerol monoacrylate, trimethylolethane monoacrylate, trimethylolpropane monoacrylate, pentaerythritol monoacrylate, 2-methoxyethyl acrylate, 2-ethoxyethyl acrylate, 2-(2-methoxyethoxy) ethyl acrylate, 2-(2-butoxyethoxy) ethyl acrylate, omegamethoxypolyethylene glycol acrylate (molar ratio of addition n=9), omega-methoxy-poly(ethylene glycol acrylate (molar ratio of addition n=23), 1-bromo-2-methoxyethyl acrylate, 1,1-dichloro-2-ethoxyethyl acrylate, 2-hydroxy-3-chloropropyl acrylate, 2-methoxyethyl methacrylate, 2-ethoxyethyl methacrylate, 2-(2-methoxyethoxy)ethyl methacrylate, 2-(2-ethoxyethoxy)ethyl methacrylate, 2-(2-butoxyethoxy)ethyl methacrylate, omega-methoxy-poly(n=6) ethyleneglycol methacrylate, omega-methoxy-poly(n=23)-ethyleneglycol methacrylate, 1-bromo-2-ethoxyethyl methacrylate, 1,1-dichloro-2-ethoxyethyl methacrylate and 2-hydroxy-3-chloropropyl methacrylate, omega-methoxy-polyethylene glycol acrylate(n=50), pentoxyethoxyethyl methacrylate, dodecoxyethoxyethyl acrylate.

The addition polymerizable unsaturated compound as a comonomer for preparing the copolymer can be, e.g., acrylic acids, acrylamides, methacrylic acids, methacryliamides, allyl compounds, vinyl ethers, vinyl esters, vinyl heterocyclic compounds, styrenes, e.g., styrene, alkylstyrene and halostyrene, maleic acids, fumaric acids, itaconic acids, and other olefinic acids, e.g., crotonic acids.

Specific examples of such copolymerizable compounds are: acrylic acid itself and acrylates, alkyl acrylates, e.g., methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethylhexyl acrylate, tert-octyl acrylate and octyl acrylate, as well as other acrylates, e.g., 2-phenoxyethyl acrylate, 2-chloroethyl acrylate, 2-bromoethyl acrylate, 4-chlorobutyl acrylate, cyanoethyl acrylate, dimethylaminoethyl acrylate, benzyl acrylate, methoxybenzyl acrylates, 2-chlorocyclohexyl acrylate, cyclohexyl acrylate, furfuryl acrylate, tetrahydrofurfuryl acrylate and phenyl acrylate; methacrylic acid itself and methacrylates, such as alkyl methacrylates, e.g., methyl methacrylate, ethyl methacrylate, n-propyl methacrylate, isopropyl methacrylate, n-butyl methacrylate, octyl methacrylate, isobutyl methacrylate, sec-butyl methacrylate, amyl methacrylate and hexyl methacrylate, as well as other methacrylates, e.g., cyclohexyl methacrylate, benzyl methacrylate, cyanoacetoxyethyl methacrylate, chlorobenzyl methacrylate, sulfopropyl methacrylate, N-ethyl-N-phenylaminoethyl methacrylate, 2-(3-phenylpropyl)ethyl methacrylate, dimethylaminophenoxyethyl methacrylates, furfuryl methacrylate, tetrahydrofurfuryl methacrylate, phenyl methacrylate, cresyl methacrylate and naphthyl methacrylate; acrylamide itself and N-substituted acrylamides, e.g., where the substituent is alkyl, hydroalkyl, aryl, aralkyl, alkylaminoalkyl, hydrocarbyloxyalkyl, cyanoalkyl, oxoalkyl, etc., such as methylacrylamide, ethylacrylamide, propylacrylamide, isopropylacrylamide, butylacrylamide, tertbutylacrylamide, heptylacrylamide, tertoctylacrylamide, cyclohexylacrylamide, benzylacrylamide, hydroxymethylacrylamide, methoxyethylacrylamide, dimethylaminoethylacrylamide, hydroxyethylacrylamide, phenylacrylamide, hydroxyphenylacrylamide, tolylacrylamide, nepthylacrylamide, dimethylacrylamide, diethylacrylamide, dibutylacrylamide, diisobutylacrylamide, N-(1,1-dimethyl-3-oxobutyl) acrylamide, methylbenzyl acrylamide, benzyloxethylacrylamide, beta-cyanoethyl acrylamide, acryloylmorpholine, N-methyl-N-acryloylpiperazine, N-acryloylpiperidine, acryloylglycine, N-(1,1-dimethyl-3-hydroxybutyl) acrylamide, N-acryloylhexamethyleneimine, N-hydroxyethyl-N-methylacrylamide, N-beta-morpholinoethylacrylamide, N-2-acetamidethyl-N-acetylacrylamide and acrylhydrazine; methacrylamide itself and substituted methacrylamides of the same types as for the acrylamides set forth above, for example, such as methylmethacrylamide, tert-butylmethacrylamide, tert-octylmethacrylamide, benzylmethacrylamide, cyclohexylmethacrylamide, phenylmethacrylamide, dimethylmethacrylamide, diethylmethacrylamide, dipropylmethacrylamide, N-hydroxyethyl-N-methylmethacrylamide, N-methyl-N-phenylmethacrylamide, N-ethyl-N-phenylmethacrylamide and methacrylhydrazine; e.g., allyl esters of carboxylic acids, such as allyl acetate, allyl caproate, allyl caprylate, allyl palmitate, allyl stearate, allyl benzoate, allyl acetoacetate and allyl lactoate, and allyl ethers, such as allyloxyethanol, allyl butyl ether and allyl phenyl ether; vinyl ethers, such as methyl vinyl ether, butyl vinyl ether, hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl vinyl ether, hydroxyethyl vinyl ether, diethyleneglycol vinyl ether, dimethylaminoethyl vinyl ether, diethylaminoethyl vinyl ether, butylaminoethyl vinyl ether, benzyl vinyl ether, tetrahydrofurfuryl vinyl ether, vinyl phenyl ether, vinyl tolyl ether, vinyl chlorophenyl ethers, vinyl 2,4-dichlorophenyl ether, vinyl naphtyl ethers and vinyl anthranyl ethers; vinyl esters, e.g., vinyl esters of carboxylic acids such as vinyl acetate, vinyl propyonate, vinyl butyrate, vinyl isobutyrate, vinyl dimethylpropionate, vinyl ethylbutyrate, vinyl valerate, vinyl caproate, vinyl chloroacetate, vinyl dichloroacetate, vinyl methoxyacetate, vinyl butoxyacetate, vinyl phenylacetate, vinyl acetoacetate, vinyl lactate, vinyl beta-phenylbutyrate, vinyl cyclohexyl carboxylate, vinyl benzoate, vinyl salicylate, vinyl chlorobenzoates, vinyl tetrachlorobenzoate, vinyl naphthoate, vinyl heterocyclic compounds, such as N-vinyloxazolidone, vinyl pyridines, 2-vinyl pyridine, 4-vinyl pyridine, vinylpicoline, N-vinylimidazole, N-vinylpyrrolidone, N-vinylcarbazole, vinylthiophene and N-vinylethylacetamide; styrene itself and its derivatives, such as methylstyrenes, e.g., $\alpha$-methyl styrene, 2-methyl styrene, dimethyl-styrenes, e.g., 2,4-dimethyl-styrene, trimethylstyrenes, ethylstyrenes, e.g., 4-ethylstyrene, diethylstyrenes, e.g., 2,4-diethylstyrene, isopropylstyrenes, butylstyrenes, hexylstyrenes, cyclohexylstyrenes, decylstyrenes, benzylstyrenes, chloromethylstyrenes, trifluoromethylstyrenes, ethoxymethylstyrenes, acetoxymethylstyrenes, methoxystyrenes, 4-methoxy-3-methylstyrene, dimethoxystyrenes, chlorostyrenes, e.g., 4-chlorostyrene, 2-chlorostyrene, dichlorostyrenes, e.g., 2,4-dichlorostyrene, trichlorostyrenes, tetrachlorostyrenes, pentachlorostyrene, bromostyrene, dibromostyrene, idostyrenes, fluorostyrenes, trifluorostyrenes, 2-bromo-4-trifluoromethylstyrene, 4-fluoro-3-trifluoromethylstyrene, vinylbenzoic acids and methyl vinylbenzoates; e.g., 2-vinylbenzoic acid, methyl 4-vinylbenzoate, crotonic acids, such as crotonic acid itself, crotonamide and butyl crotonate, hexyl crotonate, glycerol monocrotonate and like crotonates; vinyl ketones, such as methyl vinyl ketone, phenyl vinyl ketone and methoxyethyl vinyl ketone; olefines, such as dicyclopentadiene, ethylene, propylene, 1-butene, 1-pentene, 1-hexene, 4-methyl-1-pentene, 1-heptene, 1-octene, 1-decene, 5-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,6,6-trimethyl-1-heptene, 1-dodecene and 1-octadecene; itaconic acids, such as itaconic acid itself, itaconic anhydride, alkyl itaconates such as methyl itaconate, ethyl itaconate, diethyl itaconate and dibutyl itaconate; sorbic acid, cinnamic acid, methyl sorbate, citraconic acid, chloroacrylic acid, mesaconic acid; maleic acids, such as maleic acid itself, maleic anhydride, alkyl maleates such as ethyl maleate, butyl maleate, dibutyl maleate and octyl maleate; fumaric acids, such as fumaric acid itself, alkyl fumarates such as ethyl fumarate, hexyl fumarate, dibutyl fumarate and octyl fumarate; ethacrylic acid; halogenated olefins, such as vinyl chloride, vinylidene chloride and isoprene; and unsaturated nitriles, such as acrylonitrile and methacrylonitrile. If desired, there may be used a mixture of two or more of the aforesaid monomers. Among these monomers there are preferred from the viewpoint of the solubility, lucidity, oleophilicity, affinity to hydrophobic photographic substances, affinity to protective colloids and aptitude to developing treatment of copolymers, acrylates, methacrylates, vinyl esters, acrylamides and methacrylamides. The ratio of the monomer (II) to the comonomer is not critical, though it is preferred to use the monomer represented by the general formula (II) in a proportion of 5 to 100 mol %, more desirably 20 to 70 mol %.

The polymers of the present invention are soluble in or miscible with organic solvents such as alkyl alkanoates and alkyl esters of other carboxylic acids, ketones, ethers (including cyclic ethers, hydrocarbons, alcohols, N-alkyl carboxylic acid amides, etc., e.g., methyl acetate, ethyl acetate, butyl acetate, methyl isobutyl ketone, beta-ethoxyethyl acetate, methyl carbitol (methoxyethoxyethanol), dioxane, cyclohexane, cyclohexanone, dipropyleneglycol, N,N-dimethylformamide, propanol, isopropanol, methanol, butanol, sec-butanol, ethyleneglycol monomethyl ether and ethyleneglycol monobutyl ether.

The homopolymer and copolymers may be conveniently synthesized by a process such as those as described in, e.g., British Pat. No. 1,211,039, Japanese Pat. Publication No. 29195/1972, Japanese Patent Application Nos. 7174/1972, 23466/1972, 59743/1972 and 31355/1973, British Pat. No. 961,395, U.S. Pat. Nos. 3,227,672, 3,290,417, 3,262,919, 3,245,932, 2,681,897 and 3,230,275 and "Official Digest" 33, pp 719 to 736 (1961) by John C. Petropoulos et al. Of course polymerization conditions, such as initiator, concentrations, temperature and reaction time, may be varied in wide ranges.

For instance, polymerization can be carried out at temperatures generally of 20° to 180° C., preferably 40° to 120° C., by the aid of 0.05 to 5% by weight, based on the total weight of monomer or monomers, of a free radical polymerization initiator, such as, e.g., azobisisobutylonitrile and like azobis compounds; potassium persulfate, tert-butyl peroctoate, benzoyl peroxide, isopropyl percarbonate, 2,4-dichlorobenzoyl peroxide, methy ethyl ketone peroxide, cumene hydroperoxide, dicumyl peroxide and like peroxides and hydroperoxides; and redox catalysts.

The molecular weight of the polymer is not critical, though it is preferred for obtaining the advantages of the present invention to employ a polymer having a weight average molecular weight, as determined by gel permeation chromatography, of at least about 2,000, more desirably of about 10,000 to about 700,00.

Typical examples of the polymers used in the practice of the present invention are as follows:

(1) Poly(2-hydroxypropyl acrylate)
(2) Poly(2-hydroxyethyl methacrylate)
(2a) Poly(2-hydroxyethyl acrylate)
(2b) Poly(2-hydroxypropyl methacrylate)
(3) Poly(2-methoxyethyl acrylate)
(4) Poly(diethyleneglycol monoacrylate)
(5) Poly(omega-methoxypolyethyleneglycol (n=10) acrylate)
(6) Poly(omega-methoxypolyethyleneglycol (n=10) methacrylate)
(7) Poly(ethoxyethyl methacrylate)
(8) 2-Hydroxyethyl acrylate-butyl acrylate copolymer (molar ratio 20:80)
(9) 2-Hydroxyethyl acrylate-butyl acrylate copolymer (molar ratio 30:20)
(10) 2-Hydroxyethyl acrylate-butyl acrylate copolymer (molar ratio 40:60)
(11) 2-Hydroxyethyl acrylate-butyl acrylate copolymer (molar ratio 60:40)
(12) 2-Hydroxyethyl acrylate-ethyl acrylate copolymer (molar ratio 40:60)
(13) 2-Hydroxyethyl acrylate-ethyl acrylate copolymer (molar ratio 60:40)
(14) 2-Hydroxyethyl acrylate-amyl acrylate copolymer (molar ratio 30:70)
(15) 2-Hydroxyethyl acrylate-2-ethylhexyl acrylate copolymer (molar ratio 50:50)
(16) 2-Hydroxyethyl acrylate-lauryl acrylate copolymer (molar ratio 70:30)
(17) 2-Hydroxyethyl acrylate-2-hydroxypropyl methacrylate copolymer (molar ratio 30:70)
(18) 2-Hydroxyethyl acrylate-ethyl methacrylate copolymer (molar ratio 50:50)
(19) 2-Hydroxy acrylate-butyl methacrylate copolymer (molar ratio 60:40)
(20) 2-Hydroxyethyl acrylate-octyl methacrylate copolymer (molar ratio 70:30)
(21) 2-Hydroxyethyl acrylate-stearyl methacrylate copolymer (molar ratio 75:25)
(22) 2-Hydroxyethyl acrylate-N-(1,1-dimethyl-3-oxobutyl) acrylate copolymer (molar ratio 50:50)
(23) 2-Hydroxyethyl acrylate-N,N-dibutylacrylamide copolymer (molar ratio 40:60)
(24) 2-Hydroxyethyl acrylate-N,N-diethylmethacrylamide copolymer (molar ratio 60:40)
(25) 2-Hydroxyethyl acrylate-vinyl acetate copolymer (molar ratio 30:70)
(26) 2-Hydroxyethyl acrylate-allyl capronate copolymer (molar ratio 40:60)
(27) 2-Hydroxyethyl methacrylate-butyl acrylate copolymer (molar ratio 30:70)
(28) 2-Hydroxyethyl methacrylate-cyclohexyl acrylate copolymer (molar ratio 40:60)
(29) 2-Hydroxyethyl methacrylate-tetrahydrofurfuryl acrylate copolymer (molar ratio 50:50)
(30) 2-Hydroxyethyl methacrylate-hexyl methacrylate copolymer (molar ratio 50:50)
(31) 2-Hydroxyethyl methacrylate-N-(1,1-dimethyl-3-hydroxybutyl)-acrylamide copolymer (molar ratio 60:40)
(32) 2-Hydroxyethyl methacrylate-dibutyl maleate copolymer (molar ratio 60:40)
(33) 2-Hydroxypropyl acrylate-ethyl acrylate copolymer (molar ratio 50:50)
(34) 2-Hydroxypropyl acrylate-vinyl acetate copolymer (molar ratio 60:40)
(35) 2-Hydroxypropyl acrylate-vinyl butyl ether copolymer (molar ratio 60:40)
(36) Diethyleneglycol monomethacrylate-N-vinylpyrrolidone copolymer (molar ratio 50:50)
(37) Omega-methoxypolyethyleneglycol (n=23) methacrylate-p-hydroxy-styrene copolymer (molar ratio 60:40)
(38) Trimethylolpropane monoacrylate-butadiene copolymer (molar ratio 30:70)
(39) Pentaerythritol monoacrylate-butyl methacrylate copolymer (molar ratio 40:60)
(40) 2-Hydroxyethyl acrylate-2-hydroxypropyl methacrylate-butyl acrylate terpolymer (molar ratio 20:10:70)
(41) 2-Hydroxyethyl acrylate-N-(1,1-dimethyl-3-oxobutyl) acrylamide-ethyl acrylate terpolymer (molar ratio 20:40:40)
(42) 2-Hydroxypropyl acrylate-N,N-diethylacrylamide-vinyl acetate terpolymer (molar ratio 30:20:50)
(43) 2-Hydroxyethyl acrylate-butyl acrylate-vinyl acetate terpolymer (molar ratio 30:40:30)
(44) 2-Hydroxyethyl acrylate-2-butoxyethyl acrylate-amyl acrylate terpolymer (molar ratio 20:20:60)
(45) Butoxyethyl acrylate-butyl acrylate copolymer (molar ratio 50:50)

The water-immiscible mixture containing a hydrophobic photographic substance in accordance with the present invention is obtained by mixing the hydrophobic photographic substance with the polymer of the present invention. The polymer is mixed with the hydrophobic photographic substance together with a low boiling organic solvent, such as methyl acetate, ethyl acetate, butyl acetate, methyl isobutyl ketone, beta-ethoxyethyl acetate, methyl carbitol, dioxane, cyclohexanone or dipropyleneglycol. In the mixture there may be incorporated an oil former, such as tricresyl phosphate, dibutyl phthalate or acetyl tributyl citrate. As a dispersing assistant there may be used anionic surface active agents as disclosed in, e.g., Japanese Pat. Publication Nos. 4293/1964 and 4547/1971, U.S. Pat. Nos. 2,322,027, 2,360,289, 2,801,170, 2,801,171, 2,852,382, 2,949,360, 3,396,027 and 3,619,195, West Germany Pat. Nos. 1,143,707, 2,045,414, 2,043,271, and 2,045,464 and Japanese Pat. Application No. 114436/1973, and amphoteric surface active agents, such as N,N-dimethyl-N-dodecylbetaine and N-tetradecyl N,N-dipolyethylene-alpha-betaine. In most cases, the anionic or amphoteric surface active agent is used in combination with a nonionic surface active agent, as disclosed, for example, in West German Pat. No. 1,942,873.

The polymer in accordance with the present invention preferably is used in a weight ratio to hydrophobic photographic substance of 20 to 0.01, preferably 1.0 to 0.05. Dispersion of the water immiscible mixture containing a hydrophobic photographic substance in accordance with the present invention is performed by a process such as that disclosed in, e.g., U.S. Pat. Nos. 2,304,939, 2,322,027, 2,801,170, 2,801,171 and 2,949,360. It is known that as a dispersant for hydrophobic photographic substances there may be used polymerizates made up of, e.g., acrylic acid, methacrylic acid, alkyl acrylates, acrylamide, acryloylhydrazone or methacryloylhydrazine or hydrazone, as disclosed in British Pat. No. 1,293,367 and Japanese Pat. Publication No. 30494/1973. The disadvantage of the known dispersants is that it is difficult using them to prepare a stable dispersion of a water immiscible mixture containing a hydrophobic photographic substance in which the average particle size of the fine particles of the mixture is 5 microns or less, especially less than 0.2 microns. By using a polymer in accordance with the present invention as a dispersant there may be obtained with ease a stable dispersion of fine particles of a water immiscible mixture containing a hydrophobic photographic substance of an average particle size of 5 microns or less, especially of 0.2 microns or less.

The polymer in accordance with the present invention is useful for preparation of stable emulsions of fine particle sizes of hydrophobic couplers and other hydrophobic photographic substances. The other hydrophobic photographic substances include: e.g., anti-oxidants such as phenol- and hydroquinone derivatives and their precursors, as disclosed in, e.g., Belgian Pat. No. 777,487, West German Pat. No. 1,547,684, West German Pat. Application laid open No. 2,146,668, U.S. Pat. Nos. 2,336,327, 2,728,659 and 2,835,579, Japanese Pat. Application laid open No. 2128/1971 and Japanese Pat. Application No. 75126/1973; anti-fogging agents, such as, e.g., 4-hydroxy-6-methyl-1,3,3a,7-tetrazaindene, 3-methylbenzothiazole, 1-phenyl-5-mercaptotetrazole and other heterocyclic compounds, mercury-containing compounds, mercapto compounds, metallic salts and numerous other compounds, as disclosed by K. Mees in "The Theory of the Photographic Process", pp 344 to 349 (III Edition, 1966) with references to original sources and in U.S. Pat. Nos. 1,758,576, 2,110,178, 2,131,038, 2,173,628, 2,697,040, 2,304,962, 2,324,123, 2,394,198, 2,444,605-8, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, and 3,622,339 and British Pat. Application laid open Nos. 893,428, 403,789, 1,173,609 and 1,200,188; fluorescent whitening agents, such as, e.g., 4,4'-bis(4,6-di(betahydroxyethylamino) triazinylamino-stilbene, N,N'-bis(2-ethoxy-4-amino-1,3,5-triazinyl-6)-benzidine and like diaminostilbene-, benzidine-, triazole-, imidazole- and imidazolone compounds; ultraviolet absorbents, such as, e.g., 2-(2'-hydroxy-3-sec-butyl-5-tert-butylphenyl) benzotriazole, 2,6-diphenyl-4-(2'-hydroxy-4'-butoxyphenyl)-1,3,5-triazine, 2-hydroxy-4-octoxybenzophenone, phenylthienylmethylenemalondinitrile and like benzotriazole-, triazine-, benzophenone- and phenylmethylenemalonitrile compounds.

The hydrophobic couplers employed in the present invention includes, e.g., 5-pyrazolone couplers, cyanoacetylcumarone couplers, indazolone couplers, benzimidazolopyrazolone couplers, open-chained acylacetamide couplers, especially benzoylacetoanilide compounds and pyvaroylacetanilide compounds, open-chained acylacetonitrile couplers, naphthol couplers and phenol couplers.

In addition, as magenta couplers there are useful compounds represented by the following general formula (III)

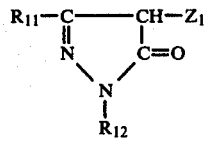

(III)

where, in the formula, $R_{11}$ represents a primary, secondary or tertiary alkyl (or substituted alkyl) such as hydroxy or aryl substituted alkyl radical, such as methyl, propyl, n-butyl, tert-butyl, hexyl, 2-hydroxyethyl or 2-phenylethyl; aryl radical, e.g., phenyl; heterocyclic radical, such as quinolinyl, pyridyl, benzofuranyl or oxazolyl; amino radical, such as methylamino, diethylamino, dibutylamino, phenylamino, tolylamino, 4-(3-sulfobenzamino)anilino, 2-chloro-5-acylaminoanilino, 2-chloro-5-alkoxycarbonylanilino or 2-trifluoromethylphenylamino; carbonamido radical, such as ethylcarbonamido, alkylcarbonamido, arylcarbonamido, benzothiazolylcarbonamido, sulfonamido or heterocyclic sulfonamido; ureido radical, such as alkylureido, arylureido or heterocyclic ureido; or alkoxy radical, such as methoxy or ethoxy: $R_{12}$ represents a hydrogen atom; aryl radical, amino, halo, alkoxy or acylamino substituted aryl radical, such as naphthyl, phenyl, 2,4,6-trichlorophenyl, 2-chloro-4,6-dimethylphenyl, 2,6-dichloro-4-methoxyphenyl, 4-methylphenyl, 4-acylaminophenyl, e.g., 4-acetylaminophenyl, 4-alkylaminophenyl, e.g., 4-methylaminophenyl, 4-trichloromethylphenyl or 3,5-dibromophenyl; heterocyclic radical, such as benzofuranyl, naphthoxazolyl or quinolinyl; or alkyl radical, such as ethyl or benzyl; and $Z_1$ represents a hydrogen atom or radical capable of splitting off upon color development, such as acyloxy, aryloxy, heterocyclicoxy, halogeno, thiocyano, disubstituted amino, aryloxycarbonyloxy, alkoxycarbonyloxy, benzotriazolyl, indazolyl, arylazo or heterocyclic azo, as disclosed in, e.g., U.S. Pat. Nos. 3,227,550, 3,252,924, 3,311,476 and 3,419,391, West German Pat. Application laid open (Offenlegungschrift) No. 2,015,867 and Japanese Pat. Application No. 56050/1973; or radical capable of liberating, upon development, a developing retarder, such as, arylmonothio radical, e.g., 2-aminophenylthio or 2-hydroxycarbonylphenylthio, heterocyclic monothio radical, and other heterocyclic radicals, e.g., tetrazolyl, tetrazinyl, triazolyl, oxazolyl, oxadiazolyl, diazolyl, thiazyl or thiadiazolyl, or heterocyclic imido radical, e.g., 1-benzotriazolyl, 1-indazolyl or 2-benzotriazolyl, as disclosed in U.S. Pat. Nos. 3,148,062, 3,227,554, 3,615,506 and 3,701,783. As yellow couplers there are useful those represented by the following general formula (IV)

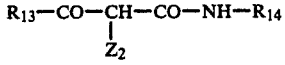

(IV)

where, in the formula, $R_{13}$ represents a primary, secondary or tertiary alkyl radical containing 1 to 18 carbon atoms, or a substituted alkyl radical, e.g., methyl, octadecyl, tert-butyl, 1,1-dimethylpropyl, 1,1-dimethyl-1-methoxyphenoxymethyl or 1,1-dimethyl-1-ethylthiomethyl, aryl and substituted aryl radicals, e.g., phenyl, alkylphenyl, 3-methylphenyl, 3-octadecylphenyl, alkoxyphenyl, 2-methoxyphenyl, 4-methoxyphenyl, halophenyl, 2-halo-5-alkamidophenyl, 2-chloro-5-(alpha-(2,4-di-tert-amylphenoxy)butylamido)-phenyl, 2-chloro-5-alkamidophenyl or 2-chloro-5-sulfonamidophenyl, amino radical, e.g., anilino, p-methoxy-anilino or butylamino; $R_{14}$ represents an aryl radical or substituted aryl radical, e.g., 2-chlorophenyl, 2-halo-5-alkamidophenyl, 2-chloro-5-(alpha(2,4-di-tert-amylphenoxy)acetamido)phenyl, 2-chloro-5-(4-methylphenylsulfonamido)phenyl or 2-methoxy-5-(2,4-di-tert-amylphenoxy)acetamidophenyl; $Z_2$ represents a hydrogen atom or radical capable of being liberated on color development, such as a halogen atom, especially a fluorine atom, acyloxy, aryloxy, heteroaromatic carbonyl, -oxy or -sulfimido, alkyl-sulfoxy, arylsulfoxy, phthalimido, dioxxoimidazolidinyl, dioxooxazolidinyl, indazolyl, dioxothiazolidinyl or like radical, as disclosed in, e.g., U.S. Pat. Nos. 3,227,550, 3,253,924, 3,277,155, 3,265,506, 3,408,194 and 3,415,652, French Pat. No. 1,411,384, British Pat. Nos. 944,490, 1,040,710 and 1,118,028 and West German Pat. Application laid open (Offenlegungsschrift) Nos. 2,057,941, 2,163,812, 2,213,461 and 2,219,971; and $Z_2$ represents a radical capable of releasing from itself a development retarder, such as a arylmonothio radical, e.g., phenylthio or 2-carboxyphenylthio, heterocyclic thio radical, 1-benzotriazole radical or 1-benzodiazole radical, especially as disclosed in Japanese Pat. Application No. 33238/1973. Cyano couplers used in the present invention may be, e.g., a naphthol coupler or a phenol coupler, especially those represented by the following general formulae (V) and (VI)

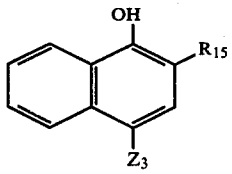

(V)

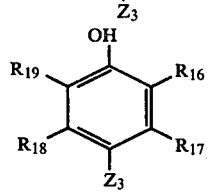

(VI)

where, in the above formulae, $R_{15}$ represents a substituent which is conventional in cyan couplers, such as a carbamyl radical, e.g., alkyl carbamyl, phenyl or like arylcarbamyl or benzothiazolylcarbamyl or like heterocyclic carbamyl, sulfamyl radical, e.g., alkylsulfamyl, phenylsulfamyl or like arylsulfamyl or heterocyclic sulfamyl, alkoxycarbonyl radical or aryloxycarbonyl radical; $R_{16}$ represents an alkyl radical, aryl radical, heterocyclic radical, amino radical, e.g., amino, alkylamino or arylamino, carbonamido radical, e.g., alkylcarbonamide or arylcarbonamido, sulfamido radical, sulfamyl radical, e.g., alkylsulfamyl or arylsulfamyl, carbamyl radical or like radical; $R_{17}$, $R_{18}$ and $R_{19}$ represent individually a radical designated with respect to $R_{16}$ or halogen atom or alkoxy radical; $Z_3$ represents a hydrogen atom or radical capable of being liberated on color development, such as an iodine atom or radical as designated with respect to $Z_2$, or a halogen atom, e.g., a chlorine atom or a bromine atom, or indazolyl, heterocyclic imido, acyloxy, aryloxy, alkoxy, sulfo, arylazo, heterocyclic azo or like radical, as disclosed in, e.g., U.S. Pat. Nos. 2,423,730, 3,227,550 and 3,311,476 and British Pat. Nos. 1,084,480 and 1,165,563. The coupler to be used in the present invention may be a colored coupler, as disclosed in, e.g., U.S. Pat. Nos. 2,983,608, 3,005,712, 3,034,892, British Pat. Nos. 936,621, 1,269,073, 586,211 and 627,814 and French Pat. Nos. 980,372, 1,091,903, 1,257,887, 1,398,308 and 2,015,649.

For the coupler to be used in the practice of the present invention it is advantageous that it has been rendered non-diffusive by introducing into the molecule a radical having a hydrophilic residue containing 8 to 32 carbon atoms. Such a residue is usually called a "ballast group". The ballast group is linked to the skeleton of a coupler molecule directly or through an imino, ether, carbonamido, sulfonamido, ureido, ester, imido, carbamoyl or sulfamoyl linkage. In the case of biequivalent couplers, the ballast group may be linked to a radical capable of being liberated on development. Some examples of the ballast groups are those as shown in the examples of the couplers to be used in the practice of the present invention.

Particular examples of the ballast groups are:

(1) Alkyl and alkenyl groups, e.g., $-CH_2-CH(C_2H_5)_2$, $-C_{12}H_{25}$, $-C_{16}H_{33}$ and $-C_{17}H_{33}$, (2) Alkoxyalkyl groups, e.g., $-(CH_2)_3-O-(CH_2)_7CH_3$ and $-(CH_2)_3-O-CH_2-\underset{\underset{C_2H_5}{|}}{CH}-(CH_2)_8-CH_3$, as disclosed in Japanese Pat. Publication No. 27563/1964, (3) Alkylaryl groups, e.g.,

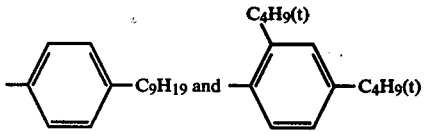

(4) Alkylaryloxyalkyl groups, e.g.,

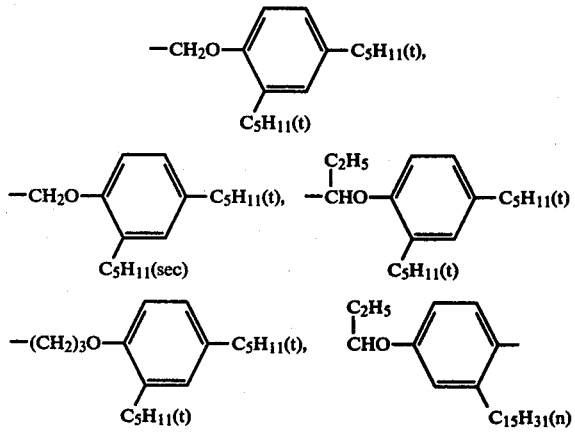

-continued

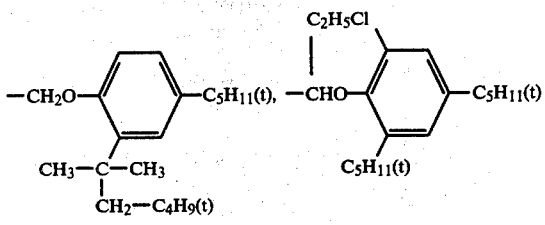

(5) Acylamidalkyl groups, e.g.,

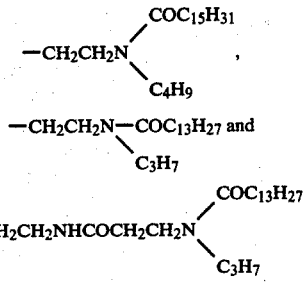

as disclosed in U.S. Pat. Nos. 3,333,344 and 3,418,129, (6) Alkoxyalyl and aryloxyaryl groups, e.g.,

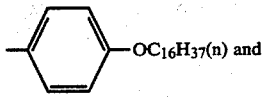

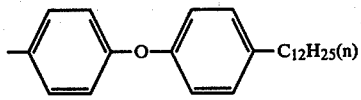

(7) Residues combining a long-chain alkyl or alkenyl aliphatic radical and a water-solubilizing carboxyl or sulfo radical, e.g.,

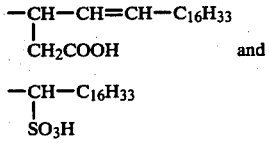

(8) Ester-substituted alkyl groups, e.g.,

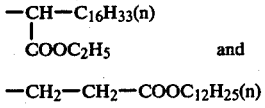

(9) Aryl- or heterocyclic radical-substituted alkyl groups, e.g.,

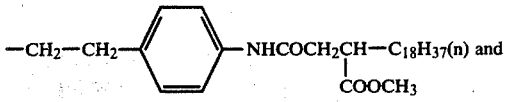

-continued

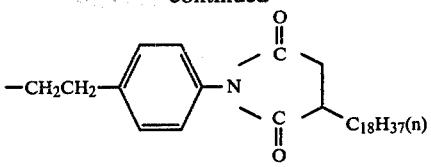

10. Aryloxyalkoxycarbonyl-substituted aryl groups, e.g.,

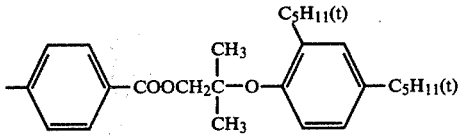

Illustrative, not limitating, examples of the couplers used in the present invention are:

(Yellow coupler)

(1) Alpha-(3-(alpha-(2,4-di-tert-amylphenoxy)-butylamido)benzoyl)-2-methoxyacetanilide, (2) Alpha-acetoxy-alpha-3-(gamma-(2,4-di-tert-amylphanoxy)butylamido)-benzoyl-2-methoxyacetanilide, (3) N-(4-anisoylacetamidobenzenesulfonyl)-N-benzyl-N-toluidine, (4) Alpha-(2,4-dioxo-5,5-dimethyloxazolidinyl)-alpha-pivaloyl-2-chloro-5-(alpha-(2,4-di-tert-amylphenoxy)butylamido)acetoanilide, (5) Alpha-(4-carboxyphenoxy)-alpha-pivaloyl-2-chloro-5-(alpha-(2,4-di-tert-amylphenoxy)-butylamido)acetanilide, (6) Alpha-(5- or 6-methyl-1-benztriazolyl)-alpha-N-4-methoxyphenyl-carbamoyl-2-methoxy-5-(alpha-(2,4-di-tert-amylphenoxy)butylamido)-acetanilide, (7) Alpha-benzoyl-alpha-(2-benzothiazolylthio)-4-(N-(gamma-phenylpropyl)-N-(4-tolyl)sulfamyl)acetanilide, (8) Alpha-pivaloyl-alpha-(5- or 6-bromo-1-benztriazolyl)-5-(alpha-(2,4-di-tert-amylphenoxy)propionamido)-2-chloroacetanilide, (Magenta coupler)

(9) 1-(2,4,6-trichlorophenyl)-3-(3-(2,4-di-tert-amylphenoxy acetamido)benzamido)-5-pyrazolone,

(10) 1-(2,4,6-trichlorophenyl)-3-(3(alpha-(2,4-di-tert-amylphenoxy)-acetamido)benzamido)-4-acetoxy-5-pyrazolone,

(11) 1-(2,4,6-trichlorophenyl)-3-tridecylamido-4-(4-hydroxyphenyl)-azo-5-pyrazolone,

(12) 1-(2,4,6-trichlorophenyl)-3-((3-tridecanoylamino-6-chloro)-anilino)-5-pyrazolone,

(13) 1-(2,4,6-trichlorophenyl)-3-(3-tetradecyloxycarbonyl-6-chloro)anilino-4-(1-naphthylazo)-5-pyrazolone,

(14) 1-(2,4-dichloro-6-methoxyphenyl)-3-((3-tridecanoylamino-6-chloro)amilino)-4-benzyloxycarbonyloxy-5-pyrazolone,

(15) 1-(4-(gamma-(2,4-di-tert-amylphenoxy)-butylamido)phenyl)-3-piperidinyl-4-(1-phenyl-5-tetrazolylthio)-5-pyrazolone,

(16) 1-Benzyl-3-(4-(alpha-(2,4-di-tert-amylphenoxy)-butylamido)-anilino)-4-(5- or 6-bromo-1-benztriazolyl)-5-pyrazolone,

(17) 1-(4-(alpha-(2,4-di-tert-amylphenoxy)acetamido)-phenyl)-3-ethoxy-4-(5- or 6-bromo-1-benztriazolyl)-5-pyrazolone, (Cyan coupler)

(18) 1-Hydroxy-N-(gamma-(2,4-di-tert-amylphenoxy)-propyl)-2-naphthamide
(19) 1-Hydroxy-4-(2-(2-hexyldecycloxycarbonyl)-phenylazo)-2-(N-(1-naphthyl))naphthamide,
(20) 1-Hydroxy-4-chloro-N-(alpha-(2,4-di-tert-amylphenoxy)butyl)-2-naphthamide,
(21) 5-Methyl-4,6-dichloro-2-(alpha-(3-n-pentadecylphenoxy)butylamino)phenol,
(22) 1-Hydroxy-4-iodo-N-dodecyl-2-naphthamide,
(23) 5-Methoxy-2-(alpha-(3-n-pentadecylphenoxy)-butylamido)-4-(1-phenyl-5-tetrazolylthio)phenol,
(Non-coloring coupler)
(24) N-(alpha(2,4-di-tert-amylphenoxy)acetyl)-omega-(1-phenyl-5-tetrazolylthio)-m-aminoacetophenone.

Together with the hydrophobic coupler to be employed in the practice of the present invention there may be used as an anti-discoloring agent for developed color image compounds as disclosed in Belgian Pat. No. 777,487, German Pat. No. 1,547,684 and West German Pat. Application laid open (Offenlegungsschrift) No. 2,146,668, and phenol and hydroquinone derivative and precursors thereof, as disclosed in U.S. Pat. Nos. 2,336,327, 2,728,659 and 2,835,579, Japanese Pat. Application laid open No. 2128/1971 and Japanese Pat. Application No. 75126/1973.

In the practice of the present invention there may be used as the silver halide emulsion those containing silver bromide, silver iodide, silver chloride or a mixture thereof, though good results are obtained when at least one photo emulsion layer comprises a silver chloroiodide, silver iodobromide or silver chloroiodobromide of an iodine content of 1 to 10 mol%. The weight ratio of silver to hydrophilic colloid binder may range preferably between 0.1 to 7.0:1, more desirably 0.4 to 1.0:1. As the hydrophilic colloid binder there are suitably used gelatin, cellulose derivatives e.g., methyl cellulose, alginates and hydrophilic synthetic polymers, such as polyvinyl alcohol, polyvinylpyrrolidone and (polystyrene)-sulfonic acid, and there may be used plasticizers and polymer latices, such as of poly(methyl methacrylate) and poly(ethyl acrylate), for improving dimensional stability.

The hydrophilic synthetic polymer, such as polyvinyl alcohol, polyvinylpyrrolidone or copolymers thereof, synergistically promotes bleaching and removal of reduced silver when used in an amount of weight ratio of hydrophilic colloid binder of 0.01 to 1.0:1, preferably of 0.05 to 0.2:1. To the silver halide emulsion there may be applied the conventional chemical sensitizing processes, e.g., gold sensitizing processes as disclosed in U.S. Pat. Nos. 2,399,083, 2,597,856 and 2,597,915, sulfur sensitizing processes as disclosed in U.S. Pat. Nos. 2,487,850 and 2,521,925, sensitizing processes by means of plural metallic ions as disclosed in U.S. Pat. Nos. 2,448,060, 2,566,245 and 2,566,263, and combinations of such processes. The silver halide photo emulsion to be used in the present invention may be color sensitized by means of one or more of the conventional color sensitizers to be employed in combination with couplers for spectral sensitization of color photosensitive materials, such as anhydro-9-methyl-5,5'-dimethyl-3,3'-di-(3-sulfopropyl)-benzselenacarbocyanine, 5,5'-dichloro-9-ethyl-di(2-hydroxyethyl)-thiacarbocyanine bromide and anhydro-5,5'-diphenyl-9-ethyl-3,3'-di(2-sulfoethyl)benzoxazolocarbocyanine hydroxide.

The silver halide photo emulsion to be used in the present invention may be incorporated with, e.g., a conventional stabilizer such as 4-hydroxy-1,3,3a,7-tetrazaindene derivatives; anti-fogging agent such as mercapto compounds and benzotriazole derivatives; coating aids such as saponin and sodium alkylbenzenesulfonates; hardeners, such as formaldehyde, mucobromic acid and sodium 2,4-dichloro-6-hydroxy-s-triazine; wetting agents and sensitizers, such as onium derivatives of such quaternary ammonium salts as disclosed in U.S. Pat. Nos. 2,271,623, 2,288,226 and 2,334,864, and poly-(alkylene oxide) derivatives as disclosed in U.S. Pat. Nos. 2,708,162, 2,531,832, 2,533,990, 3,210,191 and 3,158,484; and irradiation preventing dyes.

The term "hydrophilic colloid layer", as used in the description of the present invention, means an integral stratum of monochroic or color photo-sensitive materials consisting mainly of a hydrophilic colloid binder, and includes, e.g., silver halide emulsion layers, intermediate layers for preventing color mingling in multilayer color photo-sensitive materials and, in addition, protective layers, anti-halation layers, filter layers, mordant layers, colored layers containing therein a hydrophobic dye and layers for preventing contamination during development.

The photo-sensitive emulsions used in the present invention may be applied to various supports, such as, e.g., cellulose acetate film, poly(ethylene terephthalate) film, polypropylene film, sheet glass, baryta paper, resin-laminated paper and synthetic paper.

The hardening of the emulsion may be attained in conventional manner. Examples of hardners are, e.g., formaldehyde, glutardehyde and like aldehyde compounds; diacetyl, cyclopentanedione and like ketone compounds; bis-(2-chloroethylurea); 2-hydroxy-4,6-dichloro-1,3,5-triazine, and like reactive halogen-containing compounds, as disclosed in U.S. Pat. Nos. 3,288,775 and 2,732,303 and British Pat. Nos. 974,723 and 1,167,207; divinylsulfone, 5-acetyl-1,3-diacryloyl-hexahydro-1,3,5-triazine and like reactive olefin compounds, as disclosed in U.S. Pat. Nos. 3,635,718 and 3,232,763 and British Pat. No. 994,869; N-hydroxymethyl-phthalimide and like N-methylol compounds, as disclosed in U.S. Pat. Nos. 2,732,316 and 2,586,168; isocyanates, as disclosed in U.S. Pat. No. 3,103,437; aziridine compounds, as disclosed in U.S. Pat. Nos. 3,017,280 and 2,983,611; acid derivatives, as disclosed in U.S. Pat. Nos. 2,725,294 and 2,725,295; carbodiimide compounds, as disclosed in U.S. Pat. No. 3,100,704; epoxy compounds, as disclosed in U.S. Pat. No. 3,091,537; isoxazole compounds, as disclosed in U.S. Pat. Nos. 3,321,313 and 3,545,292; mucochloric acid and like halogenocarboxyaldehydes; dihydroxydioxane, dichlorodioxane and like dioxane derivatives; and, as inorganic hardeners, chromium alum and zirconium sulfate. In place of the aforesaid compounds, there may be used precursors thereof, such as, e.g., alkali metal bisulfite-aldehyde adducts, methylol derivatives of hydantoin and primary aliphatic nitro alcohols.

Photo-sensitive materials made of the photo emulsion in accordance with the present invention are developed by means of a developing solution capable of reducing silver halide particles into silver during the process for forming a monochromic silver image or color image. In case of monochromic development, there may be used a developing solution containing as a developing agent a polyhydroxybenzene, N-alkylaminophenol, 1-phenyl-3-pyrazolidone or mixture thereof. The polyhydroxybenezene includes, e.g., hydroquinone, pyrocatechol, pyrogallol and the like; the N-alkylaminophenols include, e.g., N-methylaminophenol, N-ethylaminophenol and the like; and the 1-phenyl-3-pyrazolidones include e.g., 1-phenyl-3-pyrazolidone itself, 1-phenyl-4,4-dimethyl-3-pyrazolidone and the like. In color development of color photo-sensitive materials made of the photo emulsion in accordance with the present invention, there may be used developing solutions containing as a developing agent a paraphenylenediamine derivative, such as 4-amino-N,N-diethylaniline, 4-amino-3-methyl-N-methyl-N-(beta-methylsulfonamidoethyl)aniline, 4-amino-3-methyl-N-ethyl-N-(beta-hydroxyethyl)aniline, 4-hydroxyaniline and 4-hydroxy-2,6-dibromoaniline.

The photo-sensitive materials in accordance with the present invention may be processed at ordinary processing temperatures, i.e., of 20° to 30° C., and at higher temperatures, i.e, of about 30° to 60° C.

The color photo-sensitive material in accordance with the present invention may conveniently be processed in the manner disclosed in, e.g., Japanese Pat. Publication No. 35749/1970, Japanese Pat. Application Nos. 67798/1969, 13313/1971 and 19516/1971, in "The British Journal of Photography", pp. 558-(15. 11. 1954), ibid pp. 440-(9. 9. 1955) and ibid pp. 2-(6. 1. 1956) by H. Gordon, ibid pp. 212-(22. 4. 1960) by S. Horwitz, ibid pp. 122-(4. 3. 1960) and pp. 396-(7. 5. 1965) by E. Gehret and ibid pp. 182-(3. 4. 1959) by J. Meech, and West German Pat. No. 2,238,051.

After color development, the photo-sensitive material of the present invention is bleached in the conventional process. The bleaching may be carried out concurrently with or separately from fixing. The processing solution may be, if desired, added with a fixing agent to form a bleaching and fixing solution. As the bleaching agent there may be used numerous compounds, though conveniently there are used: ferricyanates, bichromates, water-soluble cobalt(III) salts, water-soluble copper(II) salts, water-soluble quinones, nitrosophenols, polyvalent metallic compounds such as of iron (III), cobalt(III) and copper(II), especially complex salts of such polyvalent metal cations with organic acids, e.g., metallic complex salts of ethylenediaminetetraacetic acid, nitrilo-triacetic acid, imino-diacetic acid, N-hydroxyethylethylenediamine-triacetic acid and like amino-polycarboxylic acids, malonic acid, glutaric acid, malic acid, diglycolic acid and dithioglycolic acid, 2,6-dipicolinic acid/copper complex salt and the like; peracids, such as, e.g., alkyl peracids, e.g., peracetic and perpropionic acid, persulfates, potassium persulfate, permanganates, e.g., potassium permanganate, and hydrogen peroxide; and hypochlorites, e.g., sodium hypochlorite, chlorine, bromine and bleaching powder, either alone or in combination. The solution may be added with a bleaching promotor, as disclosed in U.S. Pat. Nos. 3,042,520 and 3,241,966 and Japanese Pat. Publication Nos. 8506/1970 and 8836/1970, and other various conventional additives.

In development, it is required to employ various devices for eliminating or minimizing factors causing environmental pollution. First, benzyl alcohol contained in a color developing solution as a development promotor is a factor causing increase of biological oxygen demand (BOD). Use of the polymeric dispersant in accordance with the present invention in combination with a coupler which has a hydroxyl or, especially a carboxyl or sulfo group in its ballast group or separable radical, e.g., $Z_1$, $Z_2$ and $Z_3$ in the aforesaid general formulae (III), (IV), (V) and (VI) makes it possible to obtain an excellent color image by using a developing solution which does not contain benzyl alcohol. Second, ferricyanides and ferrocyanides contained in the bleaching solution for reduced silver are sources of toxic cyanogen ion, and chelating agents of oxidative metallic salts are factors of difficulty encountered in waste water treatment. In the photo-sensitive materials prepared using the polymers in accordance with the present invention, a silver image or reduced silver formed is apt to be bleached. This provides an advantageous condition for a counterplan against public pollution. The photo-sensitive materials in accordance with the present invention can be bleached by means of a bleaching solution exhibiting an oxidation-reduction potential (E redox), as defined in this specification, of −150 mV to 1,000 mV and containing halide ions and a metallic salt or organic oxidizing agent. The metallic salt includes salts of transition metals, especially salts or complex salts of $Ti^{4+}$, $V^{5+}$, $Cr^{6+}$, $Mn^{7+}$, $Mn^{3+}$, $Cu^{2+}$, $Fe^{3+}$ and $Co^{3+}$, and the organic oxidizing agent includes, e.g., p-sulfophenylquinone, sulfonaphthoquinones, blue star blue radical and Waitz radical, as disclosed in, e.g., U.S. Pat. Nos. 2,507,183, 2,529,981, 2,625,477, 2,748,000, 2,810,648 and 2,705,201, British Pat. Nos. 1,111,313, 777,635, 1,032,024, 1,014,396 and 982,984 and Japanese Pat. Publication Nos. 14035/1970 and 13944/1971. There is hereby incorporated by reference and relied upon all of the United States patents, foreign patents, foreign published applications and all publications mentioned anywhere in the present specification.

The "E redox" as used in the specification is defined as the value determined by means of a composite platinum electrode, EA-216 manufactured by Metrohm, Ltd., combined with a silver/silver chloride electrode as a reference electrode and a potentiometer, E-436 manufactured by Metrohm Ltd.

EXAMPLE 1

A solution prepared by heating at 60° C. to effect solution a mixture of 10 g of magenta coupler (12) as identified above, 5 g of a 2-hydroxyethyl acrylate (40 mol%)butyl acrylate (60 mol%) copolymer of a weight average molecular weight 70,000, 20 ml of ethyl acetate and 2 ml of a 20% methanolic solution of sorbitan laurate was added to 100 ml of an aqueous solution containing 10 g of gelatin and 0.5 g of sodium dodecylbenzenesulfonate, maintained at 60° C., and the resulting mixture was stirred vigorously by means of a homogenizer to obtain an emulsified dispersion (I) of the coupler.

The same procedure was repeated except for using 5 g of dibutyl phthalate in place of the aforesaid polymer to obtain an emulsified dispersion (A).

The emulsified dispersions were stored at about 5° C. to determine the precipitation of the coupler. The precipitation in the dispersion (I) was less than that in the dispersion (A), and this indicated the remarkable improvement in stability of dispersion.

| | Precipitation of Coupler per 100 g of Dispersion | |
|---|---|---|
| Dispersion | Storage for 7 days | Storage for 28 days |
| (I) | 15 mg | 20 mg |
| (A) | 47 mg | 80 mg |

The precipitation of the coupler was determined by precisely weighing 100 g of a dispersion, diluting the dispersion with warm water to about 3 times its volume, filtering with suction the diluted dispersion using a filter paper, Toyo Roshi #5-B, and weighing the residue on the filter paper.

EXAMPLE 2

A solution prepared by heating to 60° C. a mixture of 10 g of cyan coupler (21) as identified above, 4 g of a 2-hydroxyethyl acrylate (40 mol%)-butyl acrylate (60 mol%) copolymer of a weight average molecular weight of 70,000, 1 g of dibutyl phthalate, 20 ml of ethyl acetate and 2 ml of a 20% methanolic solution of sorbitan laurate was added to an aqueous solution containing 10 g of gelatin and 0.5 g of sodium 2-ethylhexylsulfosuccinate maintained at 60° C. and the resulting mixture was mechanically stirred vigorously by means of a homogenizer to obtain an emulsified dispersion (II) of the coupler. An emulsified dispersion (B) was prepared in the same manner except for using 5 g of dibutyl phthalate in place of the aforesaid copolymer. An emulsified dispersion (B') was prepared in the same manner except for using 4 g of a butyl acrylate (85 mol%)acrylic acid (15 mol%) copolymer and 1 g of dibutyl phthalate in place of the aforesaid copolymer.

The particle sizes of oil droplets in the dispersions were determined by adding 0.3 g of the dispersion to 100 cc of warm water and subjecting to a photo-scattering method. The results summarized in the following table indicate that use of the aforesaid 2-hydroxyethyl acrylate-butyl acrylate copolymer made it possible to obtain an emulsified dispersion containing oil droplets of very fine particle sizes.

| Dispersion | Average particle size (microns) |
|---|---|
| (II) | 0.14 |
| (B) | 0.18 |
| (B') | 0.18 |

EXAMPLE 3

An emulsified dispersion (III) and (C) were prepared from each 10 g of yellow coupler (4) as identified above, by dispersing the coupler in a similar manner to that in Example 2 and subjected to determination of particle size and of stability. The results as summarized in the following table indicate that by use of the 2-hydroxyethyl acrylate (40 mol%)-butyl acrylate (60 mol%) copolymer of a weight average molecular weight 50,000 (dispersion (III)) there was obtained an emulsified dispersion containing fine oil droplets and exhibiting a remarkably improved stability compared to dispersion (C) using dibutyl phthalate.

| | Average particle sizes of emulsified dispersions (microns) | | |
|---|---|---|---|
| Dispersion | Immediately After Preparation | After storage for 7 days | After storage for 28 days |
| (III) | 0.15 | 0.16 | 0.17 |
| (C) | 0.17 | 0.19 | 0.21 |

EXAMPLE 4

A coated matter (II) was prepared by mixing 194 g of the emulsified dispersion (II) prepared in Example 2 with 250 g of a photo emulsion containing a silver chlorobromide of a chloride content of 20 mol% in a concentration of 0.40 mole halide/kg emulsion, adding thereto 15 ml of a 2% methanolic solution of 5-methyl-7-hydroxy-1,3,4,7a-tetrazaindene, 20 ml of a 2% aqueous solution of potassium polystyrenesulfonate, 10 ml of a 5% aqueous solution of sodium di-2-ethylhexylsulfosuccinate and 40 ml of a 2% aqueous solution of sodium 1-hydroxy-3,5-dichloro-5-triazine as a hardener and the final pH of the mixture adjusted to 6.5 and applying the mixture to a triacetylcellulose (cellulose triacetate) film base to obtain a coating film of a dry thickness of 6.2 microns. A coated matter (B) was prepared in the same manner using 194 g of the emulsified dispersion (B) and a coated matter (B') was prepared using 194 g of the emulsified dispersion (B').

The coated matters were subjected to stepped exposure and then to the color development under the following conditions.

(I) Color development conditions

| | | | |
|---|---|---|---|
| 1. | Color development | 30° C. | 6 minutes |
| 2. | Washing with water | 30° C. | 2 minutes |
| 3. | Bleaching fixing | 30° C. | 1½ minutes |
| 4. | Washing with water | 30° C. | 2 minutes |
| 5. | Stabilizing bath | 30° C. | 2 minutes |
| 6. | Washing with water | 30° C. | 2 seconds |
| 7. | Drying | | |

(II) Color developing solution

| | |
|---|---|
| Benzyl alcohol | 12 ml |
| Diethylene glycol | 3.5 ml |
| Sodium hydroxide | 2.0 g |
| Anhydrous sodium sulfite | 2.0 g |
| Potassium bromide | 0.4 g |
| Sodium chloride | 1.0 g |
| Borax | 4.0 g |
| Sodium trinitriloacetate | 1.6 g |
| Hydroxylamine sulfate | 2.0 g |
| 4-(N-ethyl-N-beta-methanesulfonamidoethyl)-amino-2-methylaniline sesquisulfate | 4.3 g |
| Water added to make up 1,000 ml solution (pH = 10.1) | |

(III) Bleaching fixing solution

| | |
|---|---|
| Ferric ethylenediaminetetracetate | 40 g |
| Ammonium thiosulfate (70%) | 150 ml |
| Anhydrous sodium sulfite | 12 g |
| Water added to 1,000 ml solution (pH = 6.8) | |

(IV) Stabilizing bath

| | |
|---|---|
| Sodium benzoate | 0.5 g |
| Glacial acetic acid | 13 ml |
| Citric acid dihydrate | 4.2 g |
| Sodium citrate dihydrate | 3.9 g |
| Water added to make up 1,000 ml solution (pH = 3.5) | |

By use of the 2-hydroxyethyl acrylate (40 mol%)-ethyl aceylate (60 mol%) copolymer of a weight average molecular weight of 70,000, there was obtained a photo-sensitive material having low fog and a high color density.

| Coated matter | Fog | Gradient | Maximum color density |
|---|---|---|---|
| (II) | 0.03 | 2.3 | 2.20 |
| (B) | 0.04 | 2.2 | 2.06 |

-continued

| Coated matter | Fog | Gradient | Maximum color density |
|---|---|---|---|
| (B') | 0.03 | 2.2 | 2.01 |

EXAMPLE 5

A coated matter (III) and (C) were prepared in the same manner as in Example 4 using each 269 g of the emulsified dispersion (III) and (C) prepared in Example 3, respectively, and subjected to exposure and color development in the same manner as in Example 4. The color images thus obtained were subjected to determination of light fastness and moisture resistance. The color image on the coated matter (III) prepared using the aforesaid 2-hydroxyethyl acrylate (40 mol%)-butyl acrylate (60 mol%) copolymer of a $\overline{Mw}$ 50,000 was remarkably improved in fastness to light and in moisture resistance as shown in the following table.

| Fastness of color image (Decrease in color density) | | |
|---|---|---|
| Coated matter | Light fastness | Temp. and moisture fastness |
| (III) | 7% | 6% |
| (C) | 17% | 13% |

The fastness to light was indicated by the percentage decrease in initial density in exposure for 30 days to light of intensity of 10,000 luxes from a daylight-type fluorescent lamp, and the fastness to temperature and moisture was indicated by the percentage decrease in initial density in storage in a dark place at 60° C., 75% RH, for 30 days.

EXAMPLE 6

An emulsified dispersion (IV) was prepared in the same manner as in Example 1 except for employing a 2-hydroxyethyl acrylate (50 mol%)-2-ethylhexyl acrylate (50 mol%) copolymer of a $\overline{Mw}$ 100,000 in place of the copolymer employed in Example 1. The emulsified dispersion (IV) thus obtained was low in precipitation of coupler and remarkably improved in stability compared with the emulsified dispersion (A).

| Precipitation of coupler per 100 g of emulsified dispersion | | |
|---|---|---|
| Emulsified Dispersion | Storage for 7 days | Storage for 28 days |
| (IV) | 16 mg | 22 mg |
| (A) | 47 mg | 80 mg |

Determination of the precipitation of the coupler was made in the same manner as in Example 1.

EXAMPLE 7

An emulsified dispersion (V) was prepared in the same manner as in Example 1 using a poly(ethoxyethyl methacrylate) of a $\overline{Mw}$ of 10,000 in place of the copolymer used in Example 1. Oil droplets in the resulting emulsified dispersion were very fine and were remarkably improved in stability.

| Average particle size of emulsified dispersion (microns) | | | |
|---|---|---|---|
| Emulsified Dispersion | Immediately After Preparation | After Storage for 7 days | After Storage for 28 days |
| (V) | 0.16 | 0.17 | 0.19 |

-continued

| Average particle size of emulsified dispersion (microns) | | | |
|---|---|---|---|
| Emulsified Dispersion | Immediately After Preparation | After Storage for 7 days | After Storage for 28 days |
| (A) | 0.18 | 0.20 | 0.22 |

EXAMPLE 8

An emulsified dispersion (VI) was prepared by the same procedure as in Example 2 except for using a 2-hydroxyethyl acrylate (50 mol%)-N-(1,1-dimethyl-3-oxobutyl) acrylamide (50 mol%) copolymer of a $\overline{Mw}$ of 200,000 in place of the copolymer used in Example 2. Oil droplets in the emulsified dispersion thus obtained were very fine and were remarkably improved in stability.

| Average particle size of emulsified dispersion (microns) | |
|---|---|
| Emulsified dispersion | Average particle size of oil droplets |
| (VI) | 0.16 |
| (B) | 0.13 |

EXAMPLE 9

An emulsified dispersion (VII) was prepared in the same procedure as in Example 2 except for using a 2-hydroxyethyl methacrylate (30 mol%)-butyl acrylate (70 mol%) copolymer of a $\overline{Mw}$ of 90,000 in place of the copolymer used in Example 2. Oil droplets in the resulting emulsified dispersion were very fine and remarkably improved in stability.

| Average particle size of emulsified dispersion (microns) | |
|---|---|
| Emulsified Dispersion | Average particle size of oil droplets |
| (VII) | 0.15 |
| (B) | 0.18 |

EXAMPLE 10

An emulsified dispersion (VIII) was prepared in the same procedure as in Example 2 except for use of a 2-hydroxyethyl methacrylate (60 mol%)-dibutyl maleate (40 mol%) copolymer in place of the copolymer used in Example 2. Oil droplets in the resulting emulsified dispersion were very fine and remarkably improved in stability.

| Average particle size of emulsified dispersion (microns) | | | |
|---|---|---|---|
| Emulsified Dispersion | Immediately After Preparation | After Storage for 7 days | After Storage for 28 days |
| (VIII) | 0.15 | 0.17 | 0.19 |
| (B) | 0.18 | 0.20 | 0.22 |

EXAMPLE 11

An emulsified dispersion (IX) was prepared by the same procedure as in Example 1 except for use of a 2-hydroxypropyl acrylate (50 mol%)-ethyl acrylate (50 mol%) copolymer of a $\overline{Mw}$ of 150,000 in place of the copolymer used in Example 1. Oil droplets in the resulting emulsified dispersion were very fine and remarkably improved in stability.

| Average particle size of emulsified dispersion (microns) | | | |
|---|---|---|---|
| Emulsified Dispersion | Immediately After Preparation | After Storage for 7 days | After Storage for 28 days |
| (IX) | 0.14 | 0.15 | 0.17 |
| (A) | 0.18 | 0.20 | 0.22 |

EXAMPLE 12

An emulsified dispersion (X) was prepared by the same procedure as in Example 1 except for use of an omegamethoxypoly (oxyethylene n=9) glycol methacrylate (40 mol%)-butyl acrylate (60 mol%) copolymer of a $\overline{Mw}$ of 10,000 in place of the copolymer used in Example 1. Oil droplets in the emulsified dispersion obtained were very fine and remarkably improved in stability.

| Average particle size of emulsified dispersion (microns) | | | |
|---|---|---|---|
| Emulsified Dispersion | Immediately After Preparation | After Storage for 7 days | After Storage for 28 days |
| (X) | 0.15 | 0.16 | 0.17 |
| (A) | 0.18 | 0.20 | 0.22 |

EXAMPLE 13

An emulsified dispersion (XI) was prepared by the same procedure as in Example 2 except for use of a 2-hydroxyethyl acrylate (20 mol%)-2-butoxyethyl acrylate (20 mol%)-amyl acrylate (60 mol%) terpolymer in place of the copolymer used in Example 2. Oil droplets in the emulsified dispersion obtained were very fine and remarkably improved in stability.

| Average particle size of emulsified dispersion (microns) | |
|---|---|
| Emulsified dispersion | Average particle size |
| (XI) | 0.15 |
| (B) | 0.18 |

EXAMPLE 14

Coated matters (IV) and (B) were prepared by the same procedure as in Example 4 except for use respectively of each 202 g of the emulsified dispersion (VI) and (B) prepared in Example 8, and were subjected to exposure and color development in the same manner as in Example 4. The color images thus obtained were subjected to determination of light fastness and moisture resistance in the same way as in Example 5 to obtain the results as summarized in the following table, indicating the color image on the coated matter (IV) was remarkably improved in fastness to light and to moisture.

| Fastness of color image (percentage decrease in color density) | | |
|---|---|---|
| Coated matter | Light fastness | Temperature and Moisture fastness |
| (IV) | 9% | 6% |
| (B) | 18% | 14% |

EXAMPLE 15

Coated matters (V) and (B) were prepared by the same procedure as in Example 4 except for the use respectly of each 190 g of the emulsified dispersion (VII) prepared in Example 9 and the emulsified dispersion (B), and were subjected to the exposure and color development in the same manner as in Example 4. The color images obtained were subjected to determination of fastness to light and to moisture in the same way as in Example 5 to obtain the results summarized in the following table, indicating the color image on the coated matter (V) was remarkably improved in light fastness and moisture resistance.

| Fastness of color image (percentage decrease in color density) | | |
|---|---|---|
| Coated matter | Light fastness | Temperature and moisture Fastness |
| (V) | 8% | 7% |
| (B) | 18% | 14% |

EXAMPLE 16

Coated matters (VI) and (B) were prepared by the same procedure as in Example 4 except for the use respectively of each 192 g of the emulsified dispersion (VIII) prepared in Example 10 and the emulsified dispersion (B), and were subjected to the exposure and color development in the same manner as in Example 4. The color images obtained were subjected to determination of light fastness and moisture fastness in the same way as in Example 5 to obtain the results summarized in the following table, indicating the color image on the coated matter (VI) was remarkably improved in fastness to light and to moisture.

| Fastness of color image (percentage decrease in color density) | | |
|---|---|---|
| Coated matter | Light fastness | Moisture & temperature fastness |
| (VI) | 9% | 8% |
| (B) | 18% | 14% |

EXAMPLE 17

Coated matters (VII) and (B) were prepared by the same procedure as in Example 4 except for use respectively of each 197 g of the emulsified dispersion (XI) prepared in Example 13 and the emulsified dispersion (B), and were subjected to the exposure and color development in the same manner as in Example 4 to obtain color images which were subjected to determination of fastness against light and against moisture. The color image on the coated matter (VII) was remarkably improved in fastness against light and against moisture.

| Fastness of color image (percentage decrease in color density) | | |
|---|---|---|
| Coated matter | Light fastness | Temperature & moisture fastness |
| (VII) | 5% | 4% |
| (B) | 18% | 14% |

The determinations of the fastness to light and to moisture were made in the same manner as in Example 5.

EXAMPLE 18

A solution prepared by heating to 60° C. a mixture of 51.3 g of a yellow coupler (5), 50 ml of di-n-butyl phthalate and 100 ml of butyl acetate was stirred into 500 ml of an aqueous solution containing 50 g of gelatin and 2.5 g of sodium p-dodecylbenzene-sulfonate and the resulting mixture was passed 5 times through a preheated colloid mill to effect fine dispersion of the coupler together with the solvent.

The whole of the emulsified dispersion was added to 1.0 Kg of a photo emulsion containing 54.5 g of a silver iodobromide of an iodide content of 5 mol% and 70 g of gelatin, then added thereto as a hardener 75 ml of a 4% aqueous solution of 1-hydroxy-3,5-dichloro-S-triazine. After adjustment of its pH to 6.5, the emulsion was applied to a triacetylcellulose film base to obtain a coating film having a dry thickness of 7.0 microns. The film specimen (D) thus obtained contained 863 mg/m$^2$ of Ag.

A film specimen (VIII) containing 860 mg/m$^2$ of Ag was prepared by the same procedure as mentioned above except that there was employed 40 g of a 2-hydroxyethyl acrylate (40 mol%)-butyl acrylate (60 mol%) copolymer of a $\overline{Mw}$ of 20,000, in accordance with the present invention, in place of 10 ml of di-n-butyl phthalate 40 ml of di-n-butyl phthalate.

Still another film specimen (IX) containing 854 mg/m$^2$ of Ag was prepared in the same procedure as mentioned above except that in the same photo emulsion there was added 200 ml of a 2% aqueous solution of a polyvinyl alcohol copolymer as disclosed in Japanese Pat. Application published No Showa 47(1972)-20736, corresponding to U.S. Pat. No. 3,730,726, employing the same emulsified dispersion as employed in specimen (VIII).

Specimens (VIII), (D) and (IX) were subjected to a stepped exposure for sensitometry and then to treatments as follows:

| Steps | Temperature (°C.) | Time (minutes) |
|---|---|---|
| Hardening bath | 38 | 1 |
| Washing with water | " | 1 |
| First development | " | 3 |
| Washing with water | " | 0.5 |
| Reversal exposure | Uniform exposure of emulsion side of 8,000 luxes-second | |
| Second development | 38 | 4 |
| Washing with water | " | 1 |
| Bleaching | " | 1 |
| Washing with water | " | 0.5 |
| Fixing | " | 1 |
| Washing with water | " | 1 |

| Hardening bath | | |
|---|---|---|
| Sulfuric acid (1:1) | 5.4 | ml |
| Sodium sulfate | 150 | g |
| Sodium acetate | 20 | g |
| Pyruvaldehyde (30% aqs. solution) | 15 | ml |
| Formaldehyde (37% aqs. solution) | 20 | ml |
| Water added to make up 1,000 ml of solution | | |
| **First developing solution** | | |
| 4-(N-methylamino) phenol sulfate | 2 | g |
| Sodium sulfite | 90 | g |
| Hydroquinone | 8 | g |
| Sodium carbonate monohydrate | 52.5 | g |
| Potassium bromide | 5 | g |
| Potassium thiocyanate | 1 | g |
| Water added to make up 1,000 ml solution | 1 | g |
| **Second developing solution** | | |
| Benzyl alcohol | 5 | ml |
| Sodium sulfite | 5 | g |
| Hydroxylamine hydrochloride | 2 | g |
| 4-Amino-3-methyl-N-ethyl-N-(beta-mthanesulfonamidethyl) aniline sesqui-sulfate monohydrate | 1.5 | g |
| Potassium bromide | 1 | g |
| Trisodium phosphate | 3 | g |
| Ethylenediamine (70% aqs. solution) | 7 | ml |
| Water added to make up 1,000 ml solution | | |
| **Bleaching solution** | | |
| Red prussiate | 100 | g |

-continued

| | | |
|---|---|---|
| Sodium acetate | 40 | g |
| Glacial acetic acid | 20 | ml |
| Potassium bromide | 30 | g |
| Water added to make up 1,000 ml solution | | |
| **Fixing solution** | | |
| Sodium thiosulfate | 150 | g |
| Sodium acetate | 70 | g |
| Sodium sulfite | 10 | g |
| Potassium alum | 20 | g |
| Water added to make up 1,000 ml solution | | |

After the processing, the specimens were subjected for determination of the transmissive optical density to a blue light and the transmissive optical density to a near infrared light using a filter exhibiting the maximum absorption at near the infrared region of 750 millimicrons to obtain the following sensitometrical results.

| Film Specimen | Amount of Ag coated (mg/m$^2$) | Fog | Gamma | Relative Sensitivity | Max. Density (blue) | Max. Density (near infrared) |
|---|---|---|---|---|---|---|
| (D) | 863 | 0.08 | 2.25 | 100 | 2.78 | 0.25 |
| (VIII) | 860 | 0.07 | 2.20 | 100 | 2.69 | 0.08 |
| (VI) | 854 | 0.07 | 2.17 | 100 | 2.65 | 0.03 |

Relative sensitivity: The relative value of exposure required for obtaining a density of (fog + 0.10).

It will be noticed from the results summarized in the above table, especially the minimized values of transmissive optical density to near infrared, that use of the copolymer of the present invention facilitates a sufficient desilvering by bleaching of the developed silver image which has a significant adverse effect on color reproducibility as a color photographic image in spite of the use of a large amount of a hardening agent, that is, the copolymer of the present invention possesses the characteristic of markedly improving color reproducibility and other excellent photographic characteristics as indicated by low fogs and slight changes in gradient and sensitivity.

EXAMPLE 19

A mixture of 26.0 g of a yellow coupler (4) (as identified above), 3 ml of tris-(2-ethylhexyl) phosphate, 1.2 g of 2,5-dioctylhydroquinone, 50 ml of ethyl acetate and 10 g of a 2-hydroxyethyl acrylate (40 mol%)-butyl acrylate (60 mol%) of a $\overline{Mw}$ of 40,000 in accordance with the present invention was heated to 40° C. to effect solution and added to 250 ml of an aqueous solution containing 25 g of gelatin and 1.5 g of sodium p-dodecylbenzenesulfonate, and the mixture was then vigorously agitated in a homoblender to finely disperse the coupler together with the solvent. The whole of the emulsified dispersion thus obtained was mixed with 550 g of a photo emulsion containing 27.5 g of a silver iodobromide of an iodide content of 5.0 mol% and 42 g of gelatin, then added with 35 ml of a 4% aqueous solution of 1-hydroxy-3,5-dichloro-S-triazine sodium salt as a hardener and finally its pH adjusted to 6.0 to obtain a blue-sensitive emulsion.

To a poly(ethylene terephthalate) film there was applied a gelatin solution containing black colloidal silver to form an antihalation layer of a dry thickness of 2.5 microns, then applied thereover a red-sensitive silver halide emulsion containing a cyan-forming coupler (a) of the following structural formula to form the second layer of a dry thickness of 4.5 microns.

Cyan-forming coupler(a)

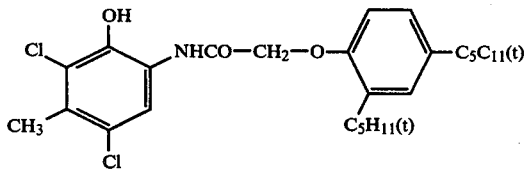

To the film there were applied sequentially a gelatin solution containing 2,5-di-tert-octylhydroquinone to form the third layer of a dry thickness of 1.5 microns, a green-sensitive silver halide emulsion containing a magenta-forming coupler (b) of the following structural formula to form the fourth layer of a dry thickness of 4.5 microns and then a gelatin layer containing yellow colloidal silver as the fifth layer of a dry thickness of 2.0 microns.

Magenta-forming coupler(b)

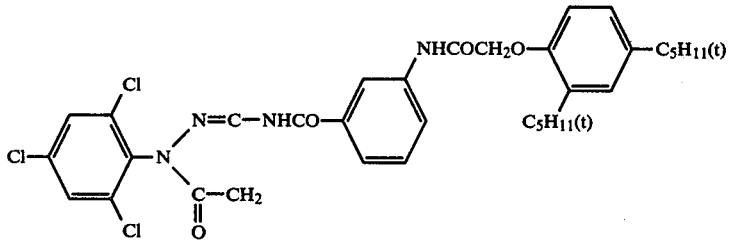

There was applied thereover the aforesaid blue-sensitive emulsion to form a blue-sensitive layer of a dry thickness of 5.0 microns and finally a protective layer of gelatin of a dry thickness of 1 micron to obtain a color photo film.

The photo film was exposed and subjected to the following process.

| Processing steps | Temperature (°C.) | Time (seconds) |
|---|---|---|
| First development | 40 | 5 |
| Color development | " | 15 |
| Stopping | " | 10 |
| Bleaching stabilizing bath | " | 90 |

The processing solutions used were of the following compositions.

| First developing solution | |
|---|---|
| 4-(N-methylamino)phenol sulfate | 5 g |
| hydroquinone | 15 g |
| Sodium sulfite | 80 g |
| Sodium carbonate monohydrate | 41 g |
| Potassium bromide | 4 g |
| Sodium hydroxide | 1 g |
| Sodium thiocyanate | 1.5 g |
| Water added to make up a 1,000 ml solution | |
| Color developing solution | |
| Sodium sulfite | 5 g |
| 4-Amino-3-methyl-N-ethyl-N-(beta-hydroxyethyl)-aniline sulfate | 10 g |
| Trisodium phosphate dodecahydrate | 100 g |
| Tris(hydroxymethyl)nitromethane | 3 g |
| Ethylenediamine (70% aqs. solution) | 11 ml |
| Sodium hydroxide | 0.1 g |
| Water added to make up an 1,000 ml solution | |
| Stopping solution | |

-continued

| | |
|---|---|
| Sodium sulfite | 40 g |
| Dihydrogen sodium phosphate dihydrate | 15 g |
| Sodium sulfate | 120 g |
| Water added to make up an 1,000 ml solution | |
| Bleaching stabilizing solution | |
| Ferric disodium ethylenediaminetetracetic acid monohydrate | 36 g |
| Ammonium thiosulfate | 100 g |
| Sodium sulfite | 7 g |
| Potassium meta-bisulfate | 15 g |
| Primary sodium phosphate | 20 g |
| Sodium carbonate monohydrate | 6 g |
| Water added to make up an 1,000 ml solution | |

The reversal color photo image was of a good transparency because of a minimized residue of developed silver and of vivid colors indicating an excellent color reproducibility. This indicates that use of the copolymer of the present invention brings about improvements not only in emulsification, dispersion, color development and stability of color image but also in elimination of developed silver image.

EXAMPLE 20

A mixture of 10 g of 2,5-di-tert-octylhydroquinone, 15 g of a butoxyethyl acrylate (50 mol%)-butyl acrylate (50 mol%) copolymer of a weight average molecular weight ($\overline{Mw}$) of 60,000, 12 ml of ethyl acetate and 15 ml of a 20% methanolic solution of sorbitan laurate was heated to 60° C. and the resulting solution was added to 500 ml of an aqueous solution containing 50 g of gelatin and 3 g of sodium dodecylbenzenesulfonate and heated at 60° C. and vigorously agitated by means of a homogenizer to obtain an emulsified dispersion (X). On the other hand, an emulsified dispersion (E) was prepared in the similar manner using 15 g of tricresyl phosphate in place of the aforesaid copolymer.

| Averge particle size of emulsified dispersion (microns) | | | |
|---|---|---|---|
| Emulsified Dispersion | Immediately After Preparation | After Storage for 7 days | After Storage for 28 days |
| (X) | 0.20 | 0.21 | 0.21 |
| (E) | 0.26 | 0.28 | 0.30 |

Oil droplets of the emulsified dispersion prepared by using the aforesaid copolymer were very fine and exhibited a remarkably improved stability.

The product can comprise, consist essentially of, or consist of the materials set forth, unless otherwise indicated all parts, ratios and percentages are by weight.

What is claimed is:

1. A method of incorporating a hydrophobic photographic substance which is a hydrophobic photographic coupler, an antioxidant, an antifogging agent or a fluorescent whitening agent into a hydrophilic colloid of a silver halide photo-sensitive material which comprising mixing said hydrophobic photographic substance with a solution in an organic solvent of an organic solvent soluble polymer containing 5 to 100 mol % of recurring units represented by the following general formula (I)

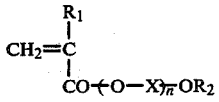

where, in the formula $R_1$ represents a hydrogen atom or methyl group; $R_2$ represents a hydrogen atom or an alkyl group containing 1 to 12 carbon atoms, X is a bivalent hydrocarbon radical containing 2 to 8 carbon atoms selected from the group consisting of a alkylene group, a haloalkylene group and a hydroxy alkylene group, and n is an integer of 1 to 50, the remaining part of the polymer being made of recurring units of an addition polymerizable unsaturated compound, the organic solvent soluble polymer being present in a weight ratio to said hydrophobic photographic substance of from 20 to 0.01:1 to form a substantially water-immiscible mixture, and finely dispersing said substantially water-immiscible mixture in an aqueous solution of said hydrophilic colloid.

2. A method according to claim 1 wherein said hydrophobic photographic substance is a hydrophobic coupler.

3. A method according to claim 1 wherein the polymer is a homopolymer or copolymer with at least one copolymerizable unsaturated monomer represented by the following general formula (II)

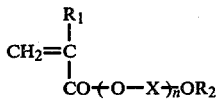

wherein the formula, $R_1$ represents a hydrogen atom or methyl group; $R_2$ represents a hydrogen atom or alkyl containing 1 to 12 carbon atoms; X represents an alkylene, haloalkylene or hydroxyalkylene group containing 2 to 8 carbon atoms; and n is an integer of 1 to 50, said copolymerizable monomer being selected from the group consisting of acrylic acid, ethacrylic acid, methacrylic acid, an acrylamide, a methacrylamide, methyl sorbate, an allyl compound, a vinyl ether, a vinyl ester, a vinyl heterocyclic compound, styrene, alkyl styrene, chloroacrylic acid, mesaconic acid, halostyrene, maleic acid, fumaric acid, itaconic acid, citraconic acid, crotonic acid, an acrylate, a methacrylate, a vinyl ketone, an olefin, itaconic anhydride, an alkyl itaconate, sorbic acid, cinnamic acid, maleic anhydride, an alkyl maleate, halogenated olefin, an alkyl fumarate and an unsaturated nitrile.

4. A method according to claim 1 wherein said organic solvent is a lower boiling organic solvent.

5. A method according to claim 4 wherein the organic solvent is a member selected from the group consisting of methyl acetate, ethyl acetate, methyl isobutyl ketone, beta-ethoxyethyl acetate, methyl carbitol, dioxane, cyclohexanone and dipropylene glycol.

6. A photo-sensitive material prepared by the process of claim 1.

7. A photo-sensitive material according to claim 6 in which the polymer is a homopolymer or copolymer with at least one copolymerizable unsaturated monomer represented by the following general formula (II)

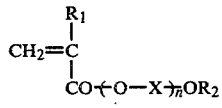

wherein the formula, $R_1$ represents a hydrogen atom or methyl group; $R_2$ represents a hydrogen atom or alkyl containing 1 to 12 carbon atoms; X represents an alkylene, haloalkylene or hydroxyalkylene group containing 2 to 8 carbon atoms; and n is a integer of 1 to 50, said copolymerizable monomer being selected from the group consisting of acrylic acid, ethacrylic acid, methacrylic acid, an acrylamide, a methacrylamide, methyl sorbate, a allyl compound, a vinyl ether, a vinyl ester, a vinyl heterocyclic compound, styrene alkyl styrene, chloroacrylic acid, mesaconic acid, halostyrene, maleic acid, fumaric acid, itaconic acid, citraconic acid, crotonic acid, an acrylate, a methacrylate, a vinyl ketone, an olefin, itaconic anhydridem, an alkyl itaconate, sorbic acid, cinnamic acid, maleic anhydride, a alkyl maleate, halogenated olefin, an alkyl fumarate and an unsaturated nitrile.

8. A silver halide photo-sensitive material according to claim 7 suitable for color photography and wherein the hydrophilic colloid containing layer comprises a silver halide photo emulsion containing dispersed therein a mixture of said polymer and a hydrophobic coupler, said mixture having an average particle size not exceeding 5 microns.

9. A silver halide photo-sensitive material according to claim 8 wherein said emulsion also has dispersed therein a high boiling oil former, said mixture of polymer and hydrophobic coupler has an average particle size not exceeding 0.2 microns, the weight ratio of polymer to coupler being from 1.0 to 0.05:1, said polymer being a polymer of 20 to 70% of said monomer having furmula II, with 80 to 30% of said copolymerizable monomer.

10. The silver halide photo-sensitive material prepared by the method of claim 3.

11. A silver halide photo-sensitive material according to claim 20 wherein $R_2$ is hydrogen.

12. A photo-sensitive material according to claim 6 in which the n in the general formula (I) is an integer of 1 to 10.

13. A photo-sensitive material according to claim 6 in which the $R_2$ in the general formula (I) is a hydrogen atom or alkyl group containing 1 to 5 carbon atoms.

14. A photo-sensitive material according to claim 7 in which the n in the general formula (II) of the monomer is an integer of 1 to 10.

15. A photo-sensitive material according to claim 7 in which the $R_2$ in the general formula (II) of the monomer is a hydrogen atom or alkyl group containing 1 to 5 carbon atoms.

16. A photo-sensitive material according to claim 7 in which the polymer contains as its integral units 20 to 70 mol% of the monomer represented by the general formula (II).

17. A photo-sensitive material according to claim 6 in which the organic solvent-soluble polymer is used in a weight ratio to hydrophilic photographic material of from 1.0 to 0.05.

18. A photo-sensitive material according to claim 6 in which the hydrophobic photographic substance is a hydrophobic coupler.

19. A photo-sensitive material according to claim 18 in which the hydrophobic coupler is a member selected from the class consisting of the compounds represented by one of the following general formulae (III), (IV), (V), and (VI)

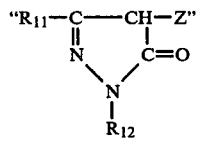

where, in the formula, $R_{11}$ represents a primary, secondary or tertiary alkyl group or substituted alkyl group, aryl group, heterocyclic radical, amino group, carbonamido group, ureido group or alkoxy group; $R_{12}$ represents a hydrogen atom, aryl group or substituted aryl group, heterocyclic radical or alkyl group; and $Z_1$ represents a hydrogen atom or radical capable of being liberated during development,

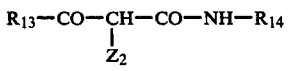

(IV)

where, in the formula, $R_{13}$ represents a primary, secondary or tertiary alkyl group or substituted alkyl group containing 1 to 18 carbon atoms, aryl group, substituted aryl group or amino group; $R_{14}$ represents an aryl group or substituted aryl group; and $Z_2$ represents a hydrogen atom or radical capable of being liberated during development,

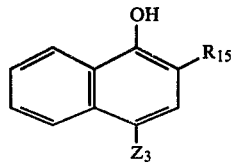

(V)

where, in the formula, $R_{15}$ represents a substituent that is conventional in cyan couplers; and $Z_3$ represents a hydrogen atom or radical capable of being liberated during development, and

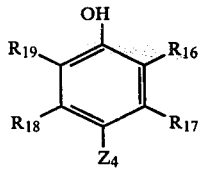

(VI)

where, in the formula, $R_{16}$ represents an alkyl group, aryl group, heterocyclic radical, amino group, carbonamido group, sulfamyl group or carbamyl group; $R_{17}$, $R_{18}$, and $R_{19}$ are as defined for $R_{16}$ or halogen or alkoxy; and $Z_4$ represents a hydrogen atom or radical capable of being liberated during development.

20. A photo-sensitive material according to claim 6 in which the hydrophilic colloid layer is a silver halide photo emulsion layer.

21. A photo-sensitive material according to claim 8 in which the hydrophilic colloid contains in addition a high boiling oil former.

22. A photo-sensitive material according to claim 8 in which the hydrophobic photographic substance is a hydrophobic coupler.

* * * * *